United States Patent [19]

Elliott et al.

[11] 4,032,046

[45] June 28, 1977

[54] APPARATUS FOR FEEDING GLUE TO A HOT MELT GLUE DISPENSING APPLIANCE

[75] Inventors: Richard Montgomery Elliott; Albert Eugene Newton, both of Beverly; John Sherburne Kelley, Wenham, all of Mass.

[73] Assignee: USM Corporation, Boston, Mass.

[22] Filed: Nov. 1, 1976

[21] Appl. No.: 737,565

[52] U.S. Cl. ..... 222/146 HE; 219/421; 226/188; 401/2

[51] Int. Cl.[2] ..... B67D 5/62

[58] Field of Search ..... 222/146 HE, 333; 401/1, 401/2, 3; 219/421, 230; 228/52, 53; 226/188

[56] References Cited

UNITED STATES PATENTS

| | | | |
|---|---|---|---|
| 3,281,576 | 10/1966 | Cooper et al. | 219/421 |
| 3,604,597 | 9/1971 | Pohl et al. | 222/146 HE |

*Primary Examiner*—Robert B. Reeves
*Assistant Examiner*—Hadd Lane
*Attorney, Agent, or Firm*—Carl E. Johnson; Richard B. Megley; Vincent A. White

[57] ABSTRACT

In a hot melt glue dispensing gun, apparatus is constructed to feed a flexible rod of glue to a heated melt chamber. This apparatus includes two motor driven gears which engage the glue rod and feed the glue to the melt chamber. This feed mechanism is mounted on a sliding frame which is spring biased to retract when the appliance is idling, thereby partially withdrawing the glue rod from the melt chamber.

7 Claims, 3 Drawing Figures

APPARATUS FOR FEEDING GLUE TO A HOT MELT GLUE DISPENSING APPLIANCE

BACKGROUND OF THE INVENTION

This invention relates to apparatus for melting and dispensing thermoplastic materials such as hot melt adhesives. This type of thermoplastic material is received in the form of an elongated, flexible rod, as disclosed, for example, in U.S. Pat. No. 2,874,084, issued Feb. 17, 1959, in the name of Hans C. Paulsen. The invention disclosed may be utilized in portable hand-operated cement extruding guns such as used for home shop use or light industrial use and disclosed, for instance, in U.S. Pat. No. 3,743,142, issued July 3, 1973, in the names of Richard M. Elliott and Albert E. Newton. The invention may also be adapted to heavier industrial usage, for example, in applying adhesives in the manufacture of shoes or in the production of package containers.

In general, the glue dispensing appliance in which the subject system is used consists of a gun shaped device having a handle and a barrel. A heat radiating body (melt body) is constructed within the barrel to transfer heat from electric heaters to a melt chamber. Means are provided in the handle to feed a flexible rod of heat activatable glue to the melt chamber. As the glue is melted it is forced out of a nozzle at the exit of the melt chamber. A thermostat or other heat sensing device is used to prevent overheating and maintain the desired temperature of the melt chamber.

In the normal operation of this type of appliance, the heaters are energized and allowed to reach operating temperature. The flow of glue is generally initiated intermittently as needed without shutting the heat off between uses. The glue gun may, therefore, sit idle for extended periods while the desired temperature is maintained by a suitable sensor-control.

When the glue rod is being fed into the melt body, it maintains a gradually diminishing solid core about which melted glue flows. The melt chamber and entrance are filled with material. When the glue gun is placed in idle condition with the heat on, but with no glue entering, the glue within the melt body melts and expands. Since the space is limited and filled, an increase in pressure results. This pressure could cause leakage through the ball valve in the nozzle or back through the control housing neither of which is desirable. In order to avoid this problem, means are provided to retract the solid core of the glue rod when the glue feed is stopped, thereby creating space in the melt body to allow for the expansion of the glue as it increases in temperature under idling condition without an increase in pressure.

SUMMARY OF THE INVENTION

The feed mechanism of this invention is comprised of two feed gears which are mounted in the glue dispensing appliance to engage the flexible glue rod from above and below. These gears are rotatably driven by two electric motors which are actuated by a trigger in the handle of the appliance. The motors are mounted on a frame which is mounted for sliding motion within the body of the appliance. The frame is spring biased away from the direction of glue feed and is connected to the trigger by a mechanical linkage. Actuation of the trigger energizes the glue feed motors and through the linkage slides the feed mechanism forward to feed the glue rod into the melt chamber entrance. Upon release of the trigger, the spring forces the feed mechanism back thereby retracting the glue rod from the melt chamber.

DESCRIPTION OF THE DRAWING

The subject invention is described in more detail below with reference to the attached drawing and in said drawing.

DESCRIPTION OF THE PREFERRED EMBODIMENT

Figure 1:
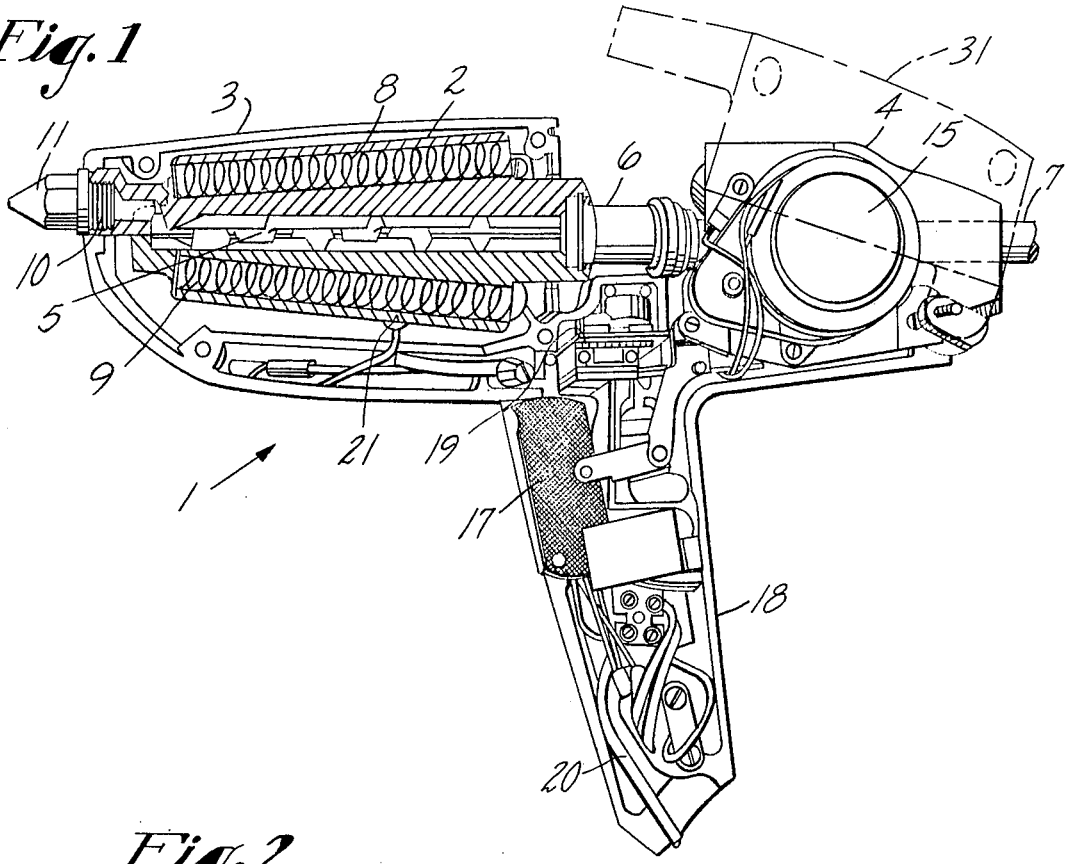
FIG. 1 is a plan view in partial section of the interior of a glue gun in which the invention may be used.

A glue gun of the type in which the subject invention is used is shown in FIG. 1. The glue gun appliance 1 consists of a melt body 2 mounted in the barrel 3 of housing 4. The melt body 2 is constructed with an inner melt chamber 5 and may be of the type described in Application for U.S. patent Ser. No. 676,220, filed Apr. 12, 1976, in the name of Richard M. Elliott and Albert E. Newton. The melt chamber 5 has an outlet 10 which provides a passage for the flexible glue rod 7. Heat is supplied from heaters 8 and 9 to the melt body 2 which radiates the heat through the melt chamber 5. An inlet 6 is constructed in the melt chamber 5 and interconnects with nozzle 11 to form an exit passage for the melted glue. A ball valve (not shown) is constructed in nozzle 11 to prohibit the exit of glue until a predetermined pressure is present in the melt chamber 5. This is to prevent leakage of residual glue during the idling cycle of operation.

Figure 2:
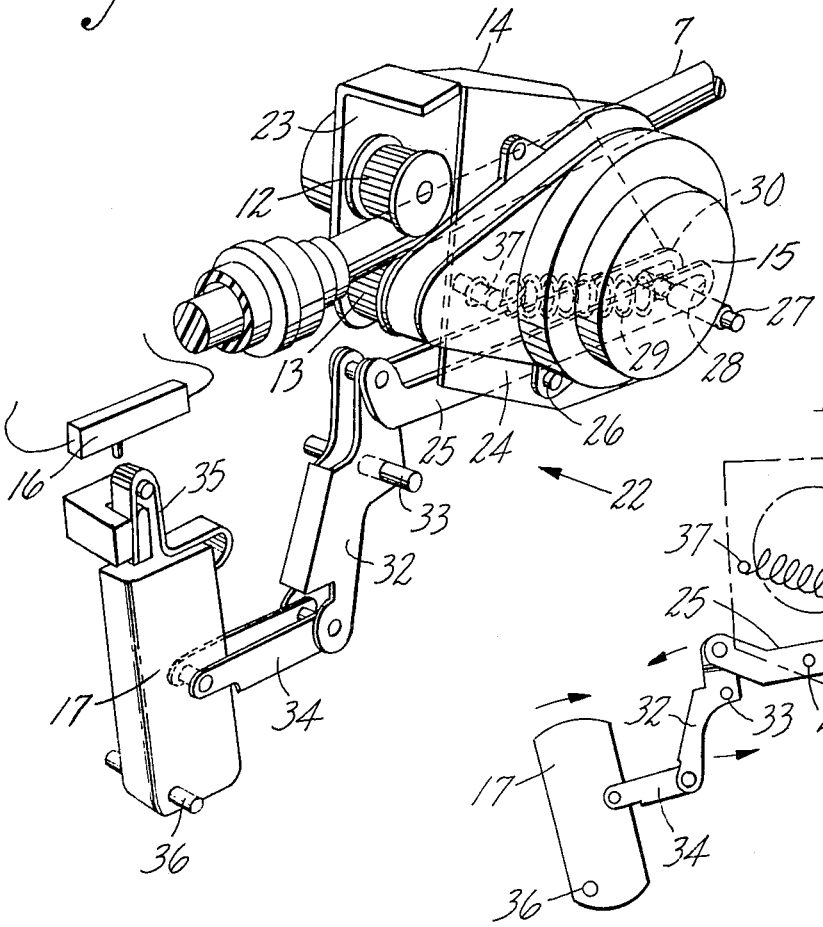
FIG. 2 is a perspective view of the feed mechanism.

As illustrated in FIG. 2, the glue rod 7 is fed into the melt chamber 5 by feed gears 12 and 13 which are driven by motors 14 and 15 respectively. The feed motors 14 and 15 are turned on by a switch 16 which is mechanically actuated by trigger 17 in the handle 18 of housing 4.

Heaters 8 and 9 are connected to a power supply through control circuit 19 and cord 20 so that the heater circuit is energized whenever the appliance 1 is plugged into a power source. The temperature of the melt body is sensed by a thermistor 21 which is embedded in the melt body 2 and the control circuit 19 is connected to regulate the heaters to a predetermined temperature. The control circuit 19 also connects feed motors 14 and 15 across a power supply through switch 16. Switch 16 is normally in the open position and is only closed when the flow of glue is desired upon manual actuation of trigger 17. The control circuit 19 may be of the type described in copending U.S. patent application Ser. No. 735,191, filed on Oct. 26, 1976, in the name of Robert J. Duncan and Richard M. Elliott.

Figure 3:
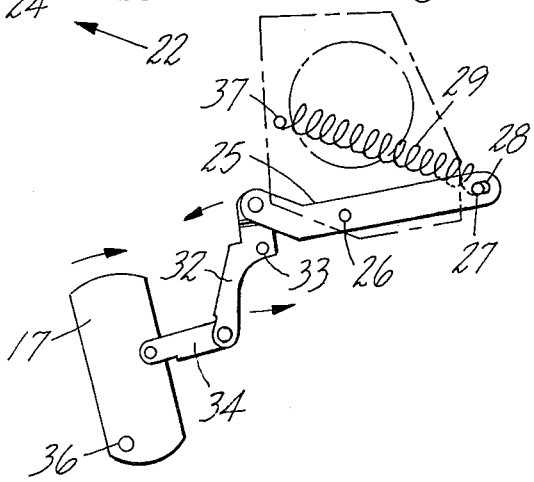
FIG. 3 is a side view of the feed mechanism retraction apparatus.

The feed mechanism 22 is shown in FIGS. 2 and 3 and consists of upper and lower feed gears 12 and 13 rotatably mounted on plates 23 and 24 respectively. The feed gears 12 and 13 are driven by motors 14 and 15 which are also mounted on plates 23 and 24. The feed gears are positioned to engage the glue rod 7 from above and below and to urge the rod 7 forward into the inlet 6 of the melt chamber 5 when the feed gears 12 and 13 are rotated. The motors 14 and 15 are energized by micro-switch 16 which may be actuated by trigger 17 through leaf spring 34.

Lower feed gear plate 24 is pivotally mounted on a frame 25 at point 26. Frame 25 is secured in housing 4 by a pivot pin 27 through slot 28. Bias spring 29 is connected between pivot pin 27 and plate 24 at pin 37 and is set to normally urge the frame 25 away from the direction of glue feed. In addition, spring 29 tends to pivot plate 24 upward to provide a resilient gripping force on the glue rod 7. Upper feed gear plate 23 is pivotally fixed to frame 25 at pin 27 and is constructed with a slot 30 through which pin 27 extends. Pivot pin 27 is fixed in the rear of housing 4. A cover 31 may be pivotally attached to housing 4 at pin 27 to allow the housing 4 to be opened in order to provide access to the feed mechanism 22. Plate 23 may be secured to cover 31 for mutual pivoting.

Frame 25 is pivotally attached to lever arm 32 which is secured to housing 4 by pivot pin 33. Lever arm 32 is operatively connected to trigger 17 by a link 34. Trigger 17 is pivotally mounted within handle 18 by pin 36. In operation glue rod 7 is threaded between feed gears 12 and 13 and trigger 17 is pulled, thereby pivoting lever arm 32 on pin 33. Frame 25 slides forward on pivot pin 27 thereby moving the feed mechanism 22 to insert the glue rod 7 into the melt chamber inlet 6. Spring 29 causes lower feed plate 23 to pivot slightly to raise feed gear 13 into firmer engagement with the glue rod 7. Simultaneously, switch 16 is actuated thereby energizing motors 14 and 15 to initiate glue flow. When the gluing operation is complete, trigger 17 is released and the feed motors 14 and 15 are shut off. Spring 29 pulls frame 25 to the rear of the housing in order to partially retract the solid core of glue rod 7 from the melt chamber. At the same time, lower feed plate 23 will pivot slightly downward to reduce the gripping force in the glue rod during idling. In this manner, a void is created in melt chamber 5 in order to allow room for expansion of the residual glue. This avoids excessive pressure which could cause leaking while the appliance is in the idle condition.

We claim:

1. In an appliance having a heated melt chamber constructed within the appliance housing, the chamber adapted to receive a flexible rod of thermally activatable glue, to melt the rod of glue, and to intermittently dispense melted glue therefrom; apparatus to feed said flexible rod of glue to the melt chamber comprising:

A. a mounting frame secured within the appliance housing for sliding movement towards and away from the melt chamber, said movement being biased away from the melt chamber;

B. power driven means mounted on the frame to engage the rod of glue and urge it towards the melt chamber;

C. an actuating lever pivotally secured on the appliance housing and operatively connected to the mounting frame to move the frame towards the melt chamber and to feed the rod of glue into the chamber when the lever is operated, said frame and rod of glue being retracted upon release of the actuating lever; and D. a switch operatively connected to the actuating lever and to the engaging means to energize said means upon operation of the actuating lever.

2. In an appliance having a heated melt chamber constructed within the appliance housing, the chamber adapted to receive a flexible rod of thermally activatable glue, to melt the rod of glue, and to intermittently dispense melted glue therefrom; apparatus to feed said flexible rod of glue to the melt chamber as described in claim 1 wherein the power driven engaging means comprises a pair of ridged feed gears which are constructed to engage the rod of glue, said gears being driven by electrical motor means to move the rod of glue into the melt chamber.

3. In an appliance having a heated melt chamber constructed within the appliance housing, the chamber adapted to receive a flexible rod of thermally activatable glue, to melt the rod of glue, and to intermittently dispense melted glue therefrom; apparatus to feed the flexible rod of glue to the melt chamber as described in claim 2 wherein the pair of feed gears are disposed above and below the rod of glue.

4. In an appliance having a heated melt chamber constructed within the appliance housing, the chamber adapted to receive a flexible rod of thermally activatable glue, to melt the rod of glue, and to intermittently dispense melted glue therefrom; apparatus to feed said flexible rod of glue of the melt chamber as described in claim 2 wherein each of the feed gears are individually driven by an electric motor, said motors being simultaneously energized by the switch upon operation of the actuating lever.

5. In an appliance having a heated melt chamber constructed within the appliance housing, the chamber adapted to receive a flexible rod of thermally activatable glue, to melt the rod of glue, and to intermmittently dispense melted glue therefrom; apparatus to feed said flexible rod of glue to the melt chamber as described in claim 1 wherein the power driven means comprises:

A. a pair of plates attached to the mounting frame;

B. a pair of ridged feed gears each rotatably mounted on one of the pair of plates; and C. a pair of electric motors, each mounted on one of the pair of plates and operatively connected to one of the pair of feed gears; said motors being simultaneously energized by the switch upon operation of the actuating lever.

6. In an appliance having a heated melt chamber constructed within the appliance housing, the chamber adapted to receive a flexible rod of thermally activatable glue, to melt the rod of glue, and to intermittently dispense melted glue therefrom; apparatus to feed said flexible rod of glue to the melt chamber as described in claim 5 wherein the pair of feed gears are disposed above and below the flexible glue rod.

7. In an appliance having a heated melt chamber constructed within the appliance housing, the chamber adapted to receive a flexible rod of thermally activatable glue, to melt the rod of glue, and to intermittently dispense melted glue therefrom; apparatus to feed said flexible rod of glue to the melt chamber comprising:

A. a mounting frame secured within the appliance housing for sliding movement towards and away from the melt chamber, said movement being spring biased away from the melt chamber;

B. an upper feed gear rotatably mounted on a first plate, said feed gear operatively connected to an electric motor fixed to said first plate, said first plate being secured to the frame for sliding movement therewith, said feed gear, plate, and motor assembly being disposed within the appliance housing to allow the feed gear to engage the glue rod from above;

C. a lower feed gear rotatably mounted on a second plate, said lower feed gear operatively connected to an electric motor fixed to said second plate, said second plate being pivotally secured to the frame for sliding movement therewith, said feed gear, plate and motor assembly being disposed within the appliance housing to allow the feed gear to engage the glue rod from below, the biasing spring of the frame being connected to the second plate to resiliently bias the lower feed gear upward into engagement with the glue rod;

D. a manually operable actuating lever pivotally secured on the appliance housing and operatively connected to the mounting frame to move the frame towards the melt chamber and to feed the rod of glue into said chamber when said lever is operated, said frame and rod of glue being retracted by the biasing spring upon release of the actuating lever; and E. a switch operatively connected to the actuating lever and the feed gear motors to energize the motors upon operation of the actuating lever.

* * * * *

UNITED STATES PATENT OFFICE

CERTIFICATE OF CORRECTION

Patent No. 4,032,046 Dated June 28, 1977

Inventor(s) Elliott et al.

It is certified that error appears in the above-identified patent and that said Letters Patent are hereby corrected as shown below:

Column 4, claim 4, line 20, after "glue", "of" should read

-- to --.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*